US005867758A

United States Patent [19]

Yoshida et al.

[11] Patent Number: 5,867,758

[45] Date of Patent: Feb. 2, 1999

[54] DEVELOPER THICKNESS-CONTROLLING BLADE AND PRODUCTION PROCESS THEREOF AS WELL AS ELECTROGRAPHIC IMAGING DEVICE

[75] Inventors: Sadaaki Yoshida; Hideki Kamaji; Tsuneo Mizuno, all of Kawasaki, Japan

[73] Assignee: Fujitsu Limited, Kanagawa, Japan

[21] Appl. No.: 701,893

[22] Filed: Aug. 23, 1996

[30] Foreign Application Priority Data

Aug. 23, 1995 [JP] Japan ..... 7-214547

[51] Int. Cl.[6] ..... G03G 15/06; G03G 21/00

[52] U.S. Cl. ..... 399/284; 399/274

[58] Field of Search ..... 399/274, 284

[56] References Cited

U.S. PATENT DOCUMENTS 4,836,135 6/1989 Kohyama et al. ..... 399/284 X
5,054,419 10/1991 Itaya et al. ..... 399/274
5,338,895 8/1994 Ikegawa et al. ..... 399/284 X
5,373,353 12/1994 Fukasawa ..... 399/284

FOREIGN PATENT DOCUMENTS 4-355777 12/1992 Japan .
6-130801 5/1994 Japan .
7-219340 8/1995 Japan .
8-69171 3/1996 Japan .

*Primary Examiner*—Fred L. Braun
*Attorney, Agent, or Firm*—Nikaido Marmelstein Murray & Oram, LLP

[57] ABSTRACT

A blade controls a layer thickness of the developer and/or triboelectrically charges the developer on a surface of the developing roller in an electrographic imaging device. The blade is a longitudinally extended member made by punching a thin resilient plate of metal in a press mold, and a tip portion thereof has a curved tail part having a smooth surface and a gradually reduced thickness formed as a shear drop upon punching.

17 Claims, 14 Drawing Sheets

×400

JG-SUS304-CSP-1/2H $t$=0.1

×400

JG-SUS304-CSP-3/4H $t$=0.1

×400

JG-SUS304-CSP-H $t$=0.1

DEVELOPER THICKNESS-CONTROLLING BLADE AND PRODUCTION PROCESS THEREOF AS WELL AS ELECTROGRAPHIC IMAGING DEVICE

BACKGROUND OF THE INVENTION

1. Field of the Invention

The present invention relates to electrography, and more particularly an electrographic imaging or image formation device as well as a developer thickness-controlling blade used in combination with a developing roller in a developing station of the imaging device and a production process for the blade. The developer thickness-controlling blade can effectively control a layer thickness of the developer distributed over a surface of the developing roller and, at the same time, triboelectrically charge the distributed developer, and accordingly it can be advantageously used in electrographic imaging devices using a nonmagnetic one-component type developer. The term "electrography" used herein means that it includes any image formation processes wherein a latent image is first produced on an image-carrying element and it is then developed with a developer to form the corresponding visible image, for example, electrophotography, xerography and the like.

2. Description of the Related Art

In recent years, with development of office automation, electrographic imaging devices such as laser printers have been used as, or in, copiers or copying machines, facsimile devices, output terminal devices for computers and others.

The conventional electrographic imaging device uses the series of process steps which include:

(a) image exposure;

(b) development;

(c) image transfer;

(d) cleaning of the residual toners; and (e) pre-charging;

and these steps are repeated. In the image exposure step, an image-carrying element such as a photosensitive drum is exposed to image-forming light, i.e., a light image, in an optical unit such as a LED array, to form a charged latent image after it has been sensitized by electrical charging in a preceding pre-charging step. The latent image is formed as a function of a photoconductive discharge of the electrically charged surface of the photosensitive drum. The formed latent image is physically developed using a toner or toning agent as a developer in a developing device. A visible image of the toner is formed on the drum surface as a result of an electrical attraction of fine particles of the toner thereto. The developed image of the toner is then transferred to an image-receiving element such as paper, and the transferred toner image is fixed thereon by fusing. In this image transfer step, some small amount of the toner remains on the surface of the photosensitive drum without being transferred to the paper, and it can adversely affect on the results of the subsequent imaging process if it is not removed from the drum. It is therefore essential in the conventional imaging process to remove the residual toner from the drum in a cleaning step, prior to reusing the drum for the next imaging process. After cleaning thereof, the drum is again sensitized, by electrical charging, in a pre-charging step.

The conventional developers used in the developing device which is also referred hereinafter to as a "developing station" include a one-component type developer essentially consisting of a toner and a two-component type developer essentially consisting of a toner and a carrier. Since it does not contain a carrier which will be deteriorated with time and must be mixed with a toner with the exactly calculated mixing ratio, the one-component type developer can be advantageously used with additional advantage that the constitution of the device used can be simplified.

The one-component type developer, when used in the imaging device, requires essential steps to compulsively electrify the developer and then adhere it onto a surface of the developing roller after application of an electric charge to the roller, because it does not contain a carrier and therefore it cannot adhere to a magnet roller as in the imaging device designed to use a two-component type developer.

Due to the above reason, to assist in electrification of the developer, the toner used in the one-component type developer generally has a relatively high volume resistivity. Further, when the toner used has a volume resistivity in the range of, for example, $10^{10}$ Ω·cm to $10^{13}$ Ω·cm or more, since it is essential to compulsively electrify the toner to obtain a predetermined polarity, a triboelectrification element or means has been widely used in combination with a developing roller in the developing station to thereby apply the triboelectrific charge to the toner.

The conventional triboelectrification means include, for example, a blade for adjusting a thickness of the toner on the developing roller to a predetermined and uniform level, to which blade a triboelectrification function was additionally introduced, and a separate electrification means exclusively used for the triboelectrification of the toner. The former means, namely, the double function blade is particularly useful, because it can simultaneously satisfy the requirements for (1) control of the toner thickness and (2) triboelectrification of the toner, and accordingly can simplify the structure of the imaging device including the developing station, in addition to reduction of the production costs of the device. Note that, as will be apparent from the detailed description of this specification, the target of the present invention is to improve the double function blade for use in combination with a developing roller in the imaging device, however, if necessary, the blade of the present invention may be used in the imaging device for a sole purpose of controlling a toner thickness or triboelectrifying the toner.

Hitherto, many types of developer (toner) thickness-controlling blades have been widely used in an electrographic imaging device, and some typical examples of the conventional blades will be described hereinafter with reference to FIGS. 1 to 5 which illustrate only a photosensitive drum 1 which is rotatable in the direction shown by an arrow "A", a developing roller 2 rotatable in the direction "B" and a blade 50 for the purpose of clarifying the function of the blade 50 in the illustrated device.

Referring to FIG. 1, a blade 50 is included in a blade holder 51 and a tip portion thereof can be elastically contacted with a surface of developing roller 2, because a predetermined pushing pressure is applied to the blade 50 from a coil spring 52 in the blade holder 51. The blade 50 is made from a relatively hard resin material or metal, and has a configuration of rectangular plate having a polished tip surface and a thickness of about 2 to 4 mm.

The blade 50 can be constantly contacted with the surface of the roller 2 at a pressure which can be modified depending upon the characteristics of the coil spring 52, however, some problems are generated. For example, due to contact of the roller 2 with the blade 50 under a high pressure and for a long time, creep and thus strain is produced in a surface of the roller 2, and an undesirably increased thickness of the toner is resulted in such strain-generated portion of the roller 2. The unevenness of the toner thickness means that laterally extending stripe-like defects may be produced in the resulting images.

Further, if the blade 50 used has an unexactly fabricated end contacting surface and edge portion, the resulting toner layer tends to have varied layer thickness in the axial direction of the roller 2, and at the same time, show insufficient triboelectrification of the toner.

Furthermore, as a result of the above-mentioned defects, further problems such as unevenness in the density of the resulting images and so-called "fogging" (partial stain) in the background of the resulting images can be generated. Moreover, since friction of the blade 50 against the roller 2 can also act against the rotational direction of the roller 2, the blade 50 can tilt slightly with regard to the blade holder 51 and thus it cannot freely move lengthwise depending upon the movement such as torsional movement of the roller 2. Such insufficient movement of the blade 50 results in the varied toner thickness and partial fogging in conformity with the rotative period of the roller 2, and in the deteriorated quality of the resulting images.

Another prior art blade is illustrated in FIG. 2. The blade 50, as is illustrated, comprises a blade holder 51 having fixed to an end portion thereof a L-shaped blade 50. The blade 50 is produced from a rigid material such as stainless steel, and due to its good elasticity, the corner portion of the blade 50 can be contacted with a surface of the developing roller 2 under a controlled and constant pressure.

However, small cracks or wrinkles can be produced in an edge of L-shaped corner portion during fabrication of the blade 50, and such small defects can adversely affect on the toner passed through a gap between the surface of the roller 2 and the corner portion of the blade 50. Namely, the toner particles are subjected to stress or a grinding action due to the cracks or wrinkles, and the thus finely pulverized. Since the toner particles are deteriorated due to the pulverization thereof, the level of the electrification of the toner particles is lowered with increase in the use time of the toner, and thus "fogging" (reduction of the quality) is caused in the images.

Another prior art blade is illustrated in FIG. 3. A blade 50 is made from an elastic material such as synthetic rubber, and is attached with an adhesive to a blade holder 51. A top end of the blade 50 is contacted with a surface of the developing roller 2 under moderate pressure.

Since it is made from the rubber or similar material, creep can be produced in the blade 50 with repeated use thereof, and thus the pressing power of the blade 5 against the roller 2 can become gradually lower, thereby resulting in reduction of the capability of triboelectrifying the toner which means the gradual formation of deteriorated images. Further, when a silicone rubber or fluoro rubber is used as the blade material in order to improve a release of the toner from the blade, a problem concerning insufficient adhesion of the blade 50 to the holder 51 is induced because of the composition of the rubber, particularly the presence of silicon or fluorine atoms. Further, since the properties such as dimensional stability of the rubber can be widely varied depending upon the environmental conditions such as temperature and humidity, the blade 50 cannot constantly show its desired properties such as durability and adhesion to the holder.

FIG. 4 illustrates one modification of the blade which was explained referring to FIG. 2. In this instance, a blade 50 is made from a rigid material such as stainless steel as in the instance of FIG. 2, however, a configuration of the blade 50 was changed from "L"-shaped cross section to "U"-shaped cross section.

Using the U-shaped blade 50, since it has a rounded corner problems observed with use of the L-shaped blade can be avoided or at least diminished. However, contrary to this advantage, there is a problem that the toner can easily adhere and fix to the blade 50, because a higher contacting pressure is applied to the blade 50 in order to compensate for the difficulty in providing a thin toner layer due to the constitution of the blade, thereby causing fusion of the toner. Fixation of the toner to the blade 50 will produce longitudinal stripe defects or other detects in the images. Further, it is difficult to ensure a constant contact of the blade 50 with the roller 2 under the predetermined pressure, because a spring coefficient of the blade 50 is increased as a function of the increase of the thickness thereof, and the increase of the blade thickness is unavoidable in the production of the blade 50, since if a relatively thin plate is used in the production of the blade 50, a smooth surface cannot be obtained in the resulting blade 50. Furthermore, the production itself of the U-shaped blade 50 from a straight plate is very difficult, and cannot be accomplished without any defect when using a simple machining process.

FIG. 5 illustrates a blade 50 which is constituted from a flat spring, and an end portion of which is fixedly mounted on a blade holder 51. A tip portion of the blade 50 has a round surface produced upon a round edge fabrication, and can be contacted with a developing roller 2 at a predetermined pressure. Since it was produced from a rolled plate having a relatively large thickness of 0.1 to 0.2 mm, the blade 50 suffers from an unevenness of the surface due to its rolled state, and therefore it is deformed when mounted to the blade holder 50. Deformation such as longitudinal waving or corrugation of the blade 50 results in varied thickness of the toner which means that undesirable differences in the density or partial "fogging" can be produced in the resulting images. Further, since its edge is subjected to a drawing process with cutting, the edge cannot be produced with a highly increased machining accuracy and reliability. This also results in "fogging", varied image density and other drawbacks, thereby deteriorating the quality of the images.

As is apparent from the above description, different toner thickness-controlling blades have been proposed for use in an electrographic imaging device in which a nonmagnetic one-component type toner is used as the developer, however, none of them could satisfy the requirements, i.e., constant contact of the blade with the developing roller under the predetermined pressure, control of the thickness of the toner layer at the predetermined level, and uniform electrification of the toner without any deterioration thereof.

Other types of toner thickness-controlling blades have been proposed in Japanese Unexamined Patent Publication (Kokai) Nos. 4-355777 and 6-130801. The blade disclosed in JP-A 4-355777 is directed to reduce a thickness of the toner layer in the dry developing device, and comprises a resilient member 53 and a blade 50 of the rubber material fixed to one end of the resilient member 53 as is illustrated in FIG. 6. The blade 50 has a length ($\ell$) of 2 to 15 mm and thickness (t) of 1 mm or more, and a curved edge thereof is contacted with a developing roller 2 under suitable pressure, thereby reducing a layer thickness of toner 4. In this instance, resilience of the resilient member 53 and elasticity of the rubber blade 50 can be effectively combined to obtain the above effects. However, since the triboelectrification of the toner 4 relies upon a silicone rubber or fluoro rubber constituting the blade 50, the toner 4 can be deteriorated due to large friction between the blade 50 and the roller 2 or discontinuous line images can be produced due to momentary stopping of the roller 2 caused because said large friction results in an increase of the load torque on the roller 2.

The blade disclosed in JP-A 6-130801 is directed to inhibit a stress applied to a developer in a developing device, thereby extending a duration of life of the developer. As illustrated in FIG. 7, a blade 31 is disposed substantially perpendicular to a surface of developing roller 2 in such manner that a gap is formed between a tip of the blade 31 and the surface of roller 2. The reference numeral 32 is a sensor for toner concentration. The blade 31 is produced by punching a metal plate, and diagonally cutting and polishing a back half portion of the tip of the resulting blade, while retaining an arch in a front half portion of the same tip. The thus produced blade 31, when disposed over the roller 2, can effectively control piling up of magnetic brushes of carriers over the roller surface, while diminishing the stress on the developer.

Apparently, JP-A 6-130801 has an object to solve a problem of the two-component type developer, i.e., undesirable piling up of magnetic brushes of carriers in said developer, and to solve this problem, it teaches how a tip of blade should be cut and polished to obtain a gap sufficient to control piling up of magnetic brushes.

SUMMARY OF THE INVENTION

One object of the present invention is to provide a developer thickness-controlling blade for use in an electrographic imaging device, which simultaneously enables effective control of the developer thickness and uniform triboelectrification of the developer, without any prior art problems such as creep and other defects in a developing roller with which the blade is contacted under pressure, cracks or wrinkling in the blade, deterioration of the developer, "fogging" and other defects in the images, and complicated and troublesome production of blade.

Another object of the present invention is to provide a production process of said blade.

Still another object of the present invention is to provide an electrographic imaging device using said blade in a developing station thereof.

The other objects of the present invention will be appreciated from the descriptions as set forth below with regard to the preferred embodiments thereof.

According to one aspect of the present invention, the above first object can be attained by a blade for controlling a layer thickness of the developer and/or triboelectrically charging the developer on a surface of developing roller in an electrographic imaging device, in which said blade is a longitudinally extended member made by punching a thin resilient plate of metal in a press mold, and a tip portion thereof has a curved tail part having a smooth surface and a gradually reduced thickness formed as a shear drop upon said punching, said tail part being able to be pressed against and elastically contacted with a developer-carrying surface of the developing roller.

According to another aspect of the present invention, the above second object can be attained by a method for the production of a blade for controlling a layer thickness of the developer and/or triboelectrically charging the developer on a surface of developing roller in an electrographic imaging device, which method comprises the steps of:

providing a press mold comprising at least one pair of a punch and a die, adjusting a gap between the punch and die to have a size sufficient to give a curved tail part to a tip portion of the blade during the subsequent punching step, and punching a thin resilient plate of metal in said press mold to thereby form said blade, a tip portion of which has a curved tail part having a smooth surface and a gradually reduced thickness formed as a shear drop, said tail part being able to be pressed against and elastically contacted with a developer-carrying surface of the developing roller in an electrographic imaging process.

Further, according to another aspect of the present invention, the above third object can be attained by an electrographic imaging device comprising a developing station which includes a developing roller and a blade for controlling a layer thickness of the developer and/or triboelectrically charging the developer on a surface of developing roller, in which said blade is a longitudinally extended member made by punching a thin resilient plate of metal in a press mold, and a tip portion thereof has a curved tail part having a smooth surface and a gradually reduced thickness formed as a shear drop upon said punching, said tail part being able to be pressed against and elastically contacted with a developer-carrying surface of the developing roller.

As will be appreciated in the following detailed description of the preferred embodiment, the developer thickness-controlling blade of the present invention can be easily produced by using a simple manner and apparatus. Further, since its tip portion has a curved tail part having a smooth surface as produced, the blade of the present invention, when used in a developer station of the electrographic imaging device and particularly in combination with one-component type developer, can effectively control the developer thickness and at the same uniformly triboelectrify the developer. No prior art problem is caused during imaging process. According to the present invention, high quality images can be produced with a high reliability without fogging or other image defects.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

Figure 1:
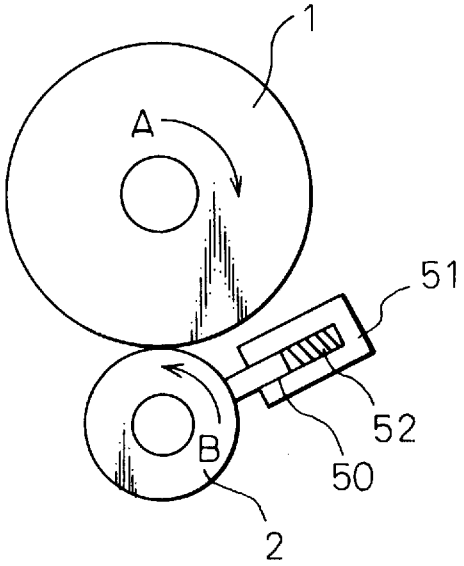
Fig.1 PRIOR ART
FIG. 1 is a cross-sectional view illustrating the constitution of the blade in the first prior art imaging device.
Figure 2:
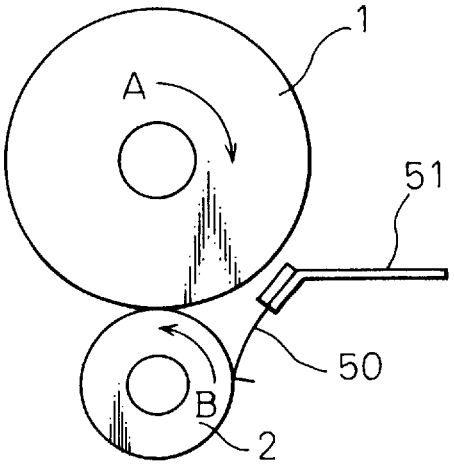
Fig.2 PRIOR ART
FIG. 2 is a cross-sectional view illustrating the constitution of the blade in the second prior art imaging device.
Figure 3:
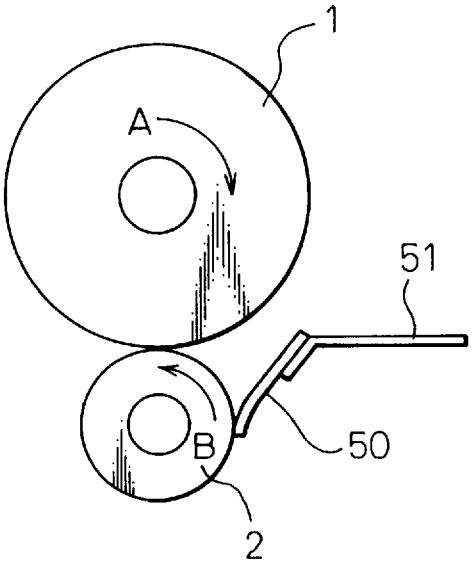
Fig.3 PRIOR ART
FIG. 3 is a cross-sectional view illustrating the constitution of the blade in the third prior art imaging device.
Figure 4:
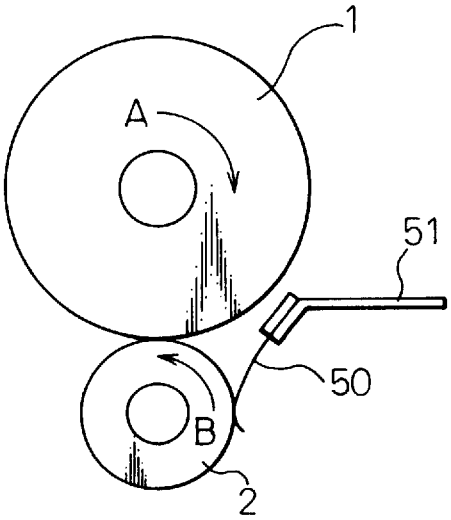
Fig.4 PRIOR ART
FIG. 4 is a cross-sectional view illustrating the constitution of the blade in the fourth prior art imaging device.
Figure 5:
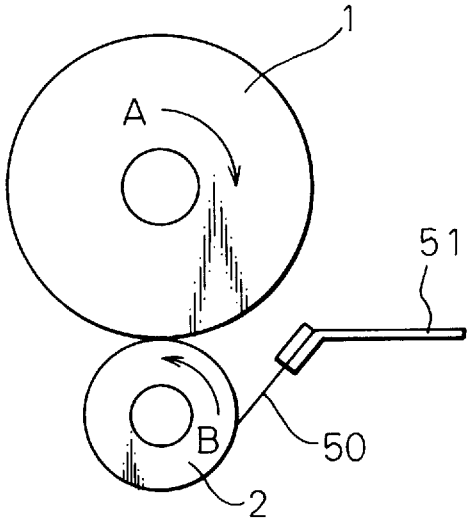
Fig.5 PRIOR ART
FIG. 5 is a cross-sectional view illustrating the constitution of the blade in the fifth prior art imaging device.
Figure 6:
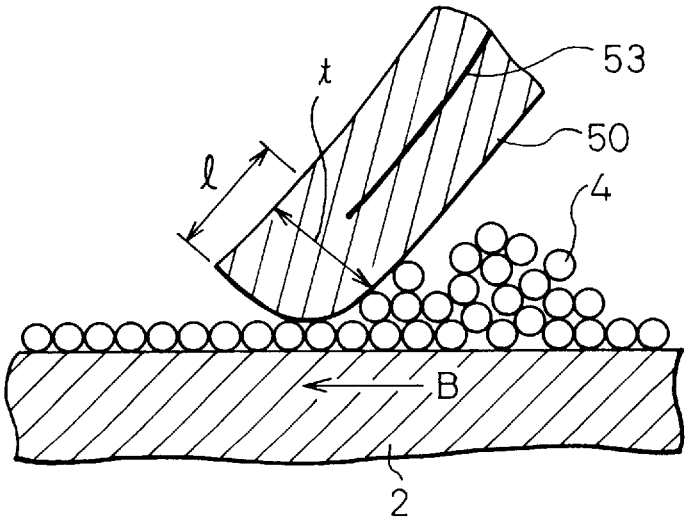
Fig.6 PRIOR ART
FIG. 6 is a cross-sectional view illustrating the constitution of the blade in the sixth prior art imaging device.
Figure 7:
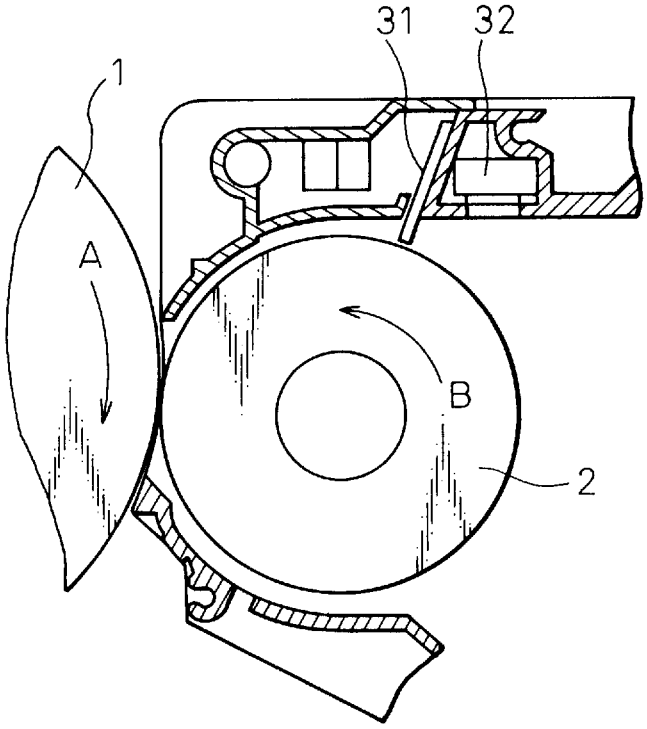
Fig.7 PRIOR ART
FIG. 7 is a cross-sectional view illustrating the constitution of the blade in the seventh prior art imaging device.

The present invention will be described with reference to FIG. 8 which illustrates an electrographic imaging device according to a preferred embodiment of the present invention. The developer used herein is a nonmagnetic one-component type developer which exclusively contains a toner. Of course, if desired, a two-component type developer may be used in place of the one-component type developer in the practice of the present invention.

The illustrated imaging device comprises a photosensitive drum 1 which is rotated in the direction shown by an arrow "A". The photosensitive drum 1 carries a photosensitive layer of an organic photoconductor (OPC) material, and has a diameter of 40 mm. A peripheral speed of this drum is 70 mm/s.

The photosensitive drum 1 is electrostatically charged by a pre-charging device 13 to adjust a surface potential of the drum 1 to −650 volts. The pre-charging device 13 used herein is a rotating brush, however, if desired, any other conventional charging means such as corotron or scorotron charger may be used.

Then, the photosensitive drum 1 is exposed to a light image from an exposure system (not shown) such as a laser-scanning optical system or, for example, an LED array which can emit light depending upon a predetermined imaging signal, thereby forming a charged latent image on the drum surface.

The resulting latent image is then developed with fine particles of a nonmagnetic one-component type developer or toner in a developing device or station 6. As is illustrated, the developing station 6 is constituted by a developing roller 2, a toner-supplying and recovering roller 3, toner (not shown) contained in a frame 6*a* of the developing station 6, a toner thickness-controlling blade 5 of the present invention capable of acting also as an electrifying means, an agitating roller 7, a paddle roller 8, a toner bottle 9 and an outer roller 10.

In the developing station 6, upon contacting with the photosensitive drum 1, the developing roller 2 is rotated at a peripheral speed which is twice of that of the drum 1 and in the opposite rotative direction as the drum 1. The toner is supplied from the roller 3 to the roller 2, and the toner carried on the roller 2 is guided beneath the blade 5 to form a thin layer of the toner over a surface of the roller 2. Since the rotating drum 1 is contacted with the roller 2, the toner layer of the roller 2 is transferred and adhered to the latent image of the drum 1. A visible image of the toner is thus formed on the surface of the drum 1. Note that in S the developing roller 2, the not-transferred toner layer is retained, and then scraped with the roller 3 rotating in the same direction as that of the roller 2.

Fresh toner is supplied from the toner bottle 9. The fresh toner is picked up with the outer roller 10, uniformly mixed by the agitator 7, and then effectively supplied to the roller 3 by means of the paddle roller 8.

The visible toner image adhered to the surface of the drum 1 is then guided to an image transfer station provided with an image transfer roller 11, wherein the toner image is transferred to a recording paper 21 supplied from a paper cassette or hopper 20. The transfer roller 11 is electrically connected to a DC electric source. The transferred toner image is fused and fixed to the paper 21, while the paper 21 is guided between a pair of fixing rollers 12.

After transfer of the toner image to the paper 21, the surface of the photosensitive drum 1 is cleaned with a cleaner 16 in order to completely remove a residual toner from the drum surface. After removal of the residual toner from a surface thereof, the drum 1 is again charged by the pre-charging device 13 for reuse in the next imaging process.

The toner thickness-controlling blade 5 of the present invention will be further described with reference to the accompanying drawings, and before doing so, another doctor blade for controlling a toner thickness on the developing roller also invented by the same inventors (Mizuno and Yoshida) will be described to assist in further understanding of the present invention. Note that said doctor blade was disclosed in Japanese Unexamined Patent Publication (Kokai) No. 8-69171 publicly disclosed on Mar. 12, 1996, i.e., later than the priority date (Aug. 23, 1995) of the present application.

Figure 8:
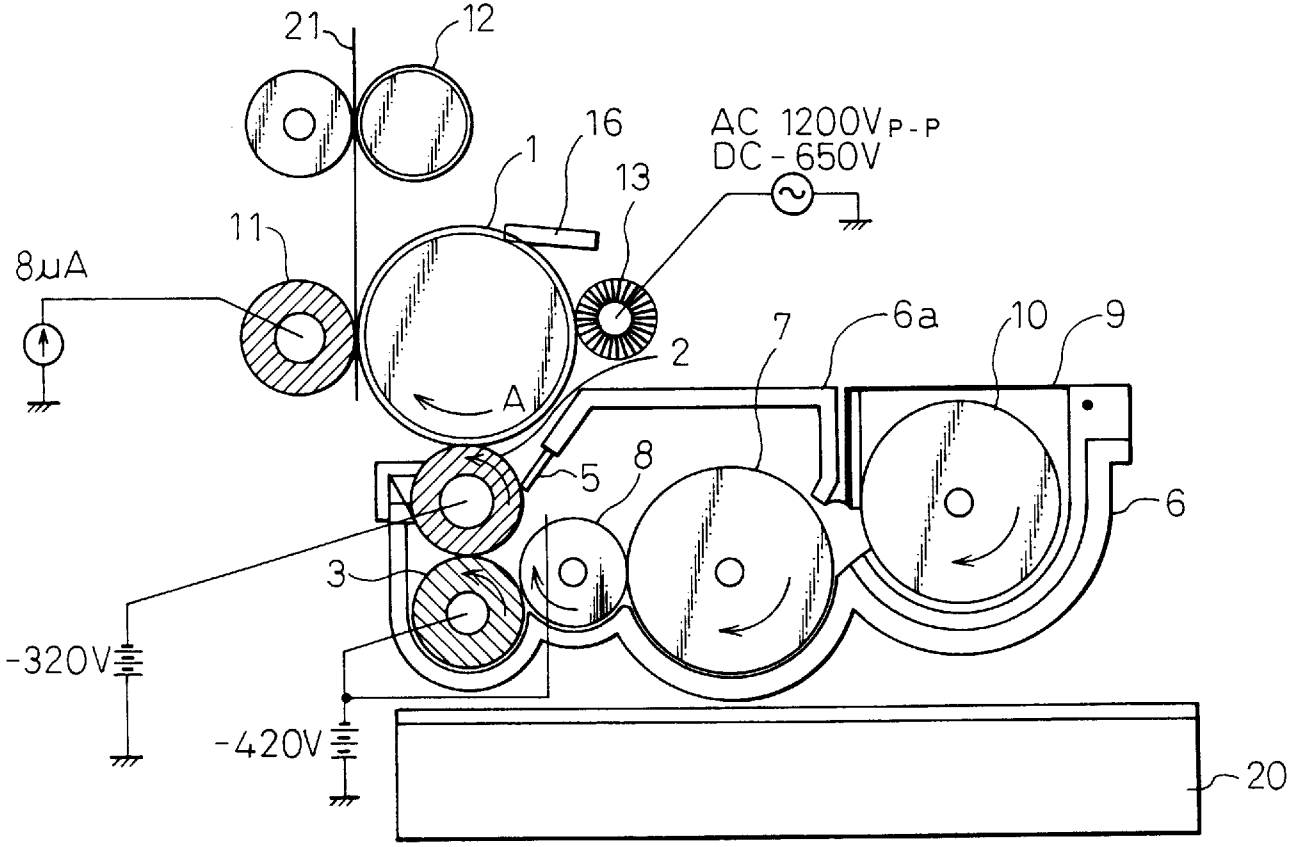
FIG. 8 is a cross-sectional view of the electrographic imaging device according to one preferred embodiment of the present invention.
Figure 9:
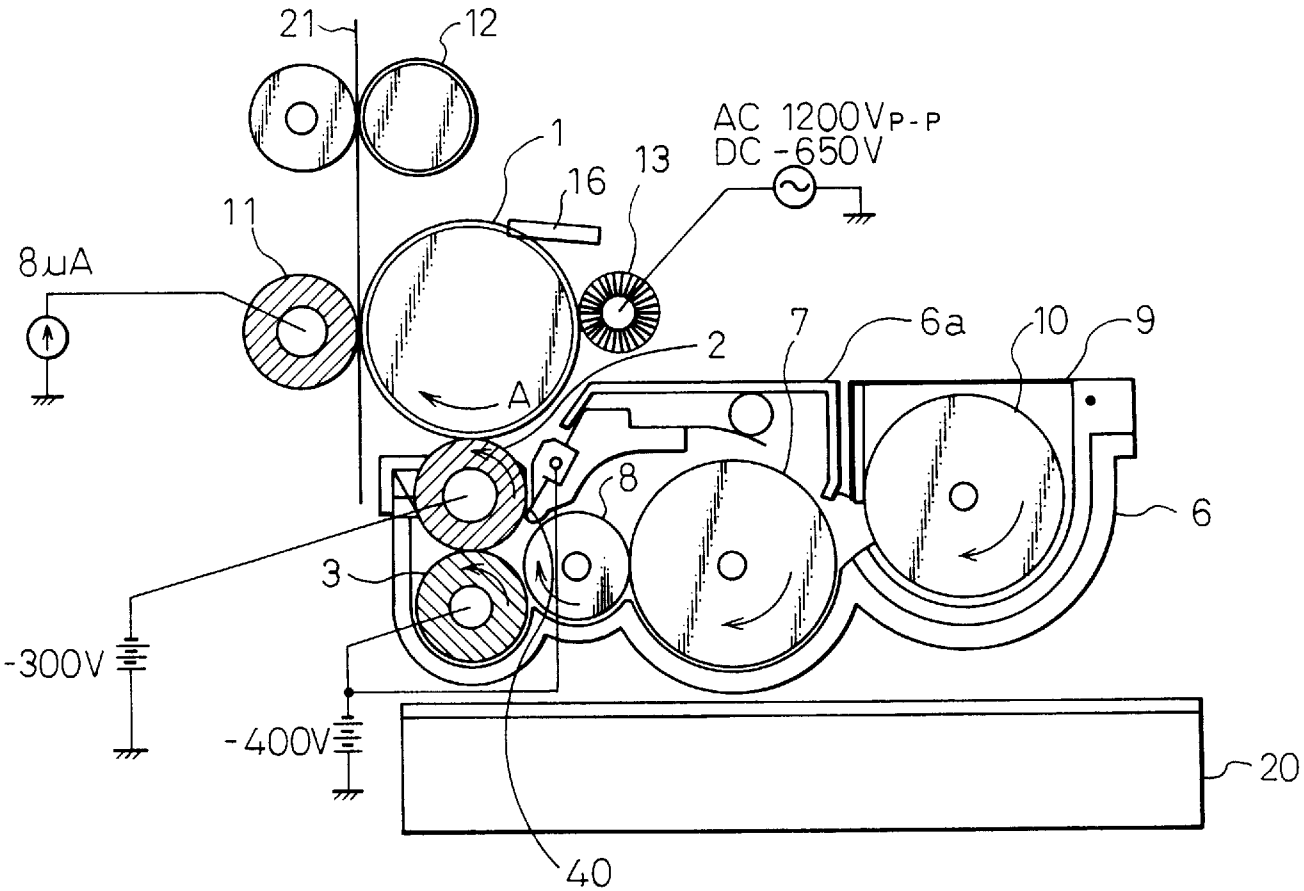
FIG. 9 is a cross-sectional view of the electrographic imaging device according to the invention of the inventors'prior application.
Figure 10:
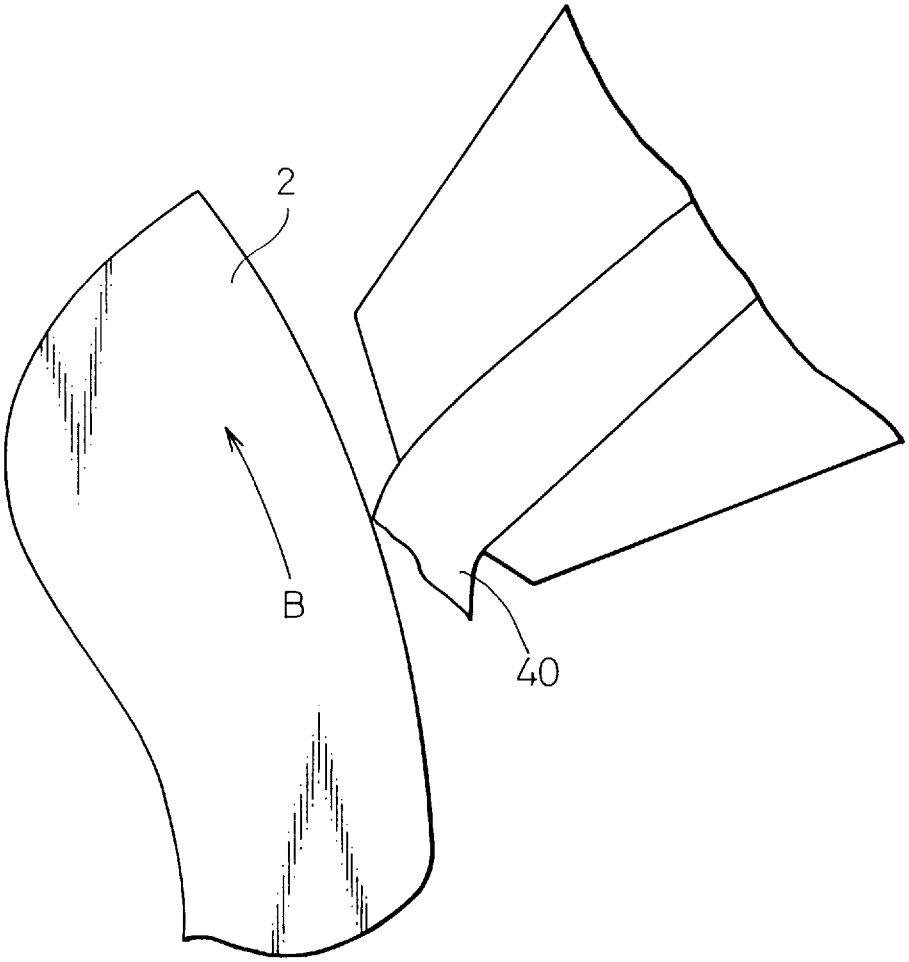
FIG. 10 is a cross-sectional view illustrating the constitution of the blade in the imaging device of FIG. 9.

JP-A 8-69171 teaches an electrographic imaging device illustrated in FIG. 9 which is substantially the same as that of FIG. 8 except that a doctor blade 40 (FIG. 9) is clearly distinguished from the blade 5 (FIG. 8). As is illustrated in FIG. 10, the doctor blade 5 has a configuration as produced (see, FIG. 11), and is slightly protruding from a top surface of the layer thickness-controlling device. The doctor blade 40 has no spring function as in the blade 5 of the present invention, because its length is very short (about 0.6 mm) and is made of a thick and rigid plate of metal such as steel.

Figure 11A:
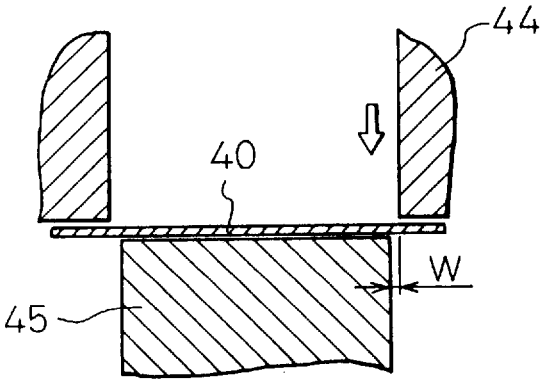
FIG. 11(A) and 11(B) a are cross-sectional view illustrating the production of the blade of FIG. 10.
Figure 11B:
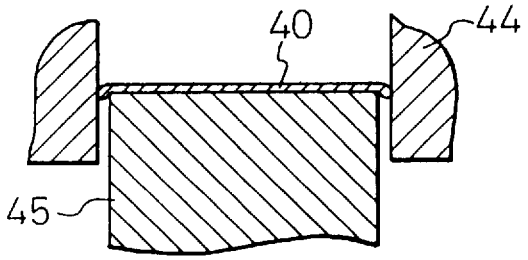

The doctor blade 40 of JP-A 8-69171 can be produced by using a manner illustrated in FIG. 11. As illustrated in Fig. 11(A), the metal plate 40 is inserted between a mold 45 (male mold) and a die 44 (female mold) with a clearance (w), and then the die 44 is downwardly pressed as shown by an arrow. As a result, both ends of the plate 40 are bent as is shown in FIG. 10.

The doctor blade 40 could overcome the prior art problems disclosed in JP-A 8-69171, and provide advantages such as stable formation of the toner layer without deterioration of the toner and image formation with a high density and low fogging. However, it could not fully solve the above-mentioned problems, solved by the present invention. Namely, the toner thickness-controlling blade of the present invention was invented by the same inventors as a result of zealous study of the problems in both the above-mentioned prior art blades and the lastly mentioned doctor blade.

Referring again to FIG. 8, the illustrated imaging device may be modified within the scope and spirit of the present invention, if desired. For example, in the practice of the present invention, the photosensitive drum 1 may comprise a metallic drum such as an aluminum drum having applied, on the surface thereof, a photosensitive layer of selenium, selenium alloy, zinc oxide, cadmium sulfide, or organic photoconductor materials such as phthalocyanine. A function separation-type organic photoconductor material is advantageously used in the formation of the photosensitive layer. Both the diameter of the drum and the layer thickness of the photosensitive layer can be widely varied depending upon the dimensions of the imaging device and other factors.

An image exposure system is located over the photosensitive drum. The position of the image exposure system is selected so that an electrostatically charged latent image is suitably formed on a surface of the photosensitive drum. Examples of suitable image exposure systems include any conventional optical image-providing systems such as LED (light emitting diode), laser, liquid crystal shutter and EL (electroluminescence) optical systems.

On the downstream side of the image exposure system, a developing station 6 is disposed. The developing station used herein has been described in detail, however, any modification may be applied to said developing station, if desired.

Any developer may be used in the developing station 6, and can be a one-component type developer, a 1.5-component type developer or a two-component type developer. Namely, the developer may comprise a magnetic or nonmagnetic toner with or without a magnetic or nonmagnetic carrier. The toner used is conventional one containing, as black pigments, carbon black and the like, and the carrier used is also conventional one such as magnetic powders, for example, iron or ferrite powder. The magnetic powders may be coated with or dispersed in a polymeric resin. Preferably, a one-component type developer comprising only a nonmagnetic toner is used in the developing station.

An image transfer roller 11 for transferring the developed image to a recording paper 21 as an image-receiving element is disposed downstream of the developing station 6. Any conventional transfer roller may be used in the imaging device of the present invention. The image transfer roller can retain a stable and high transfer efficiency under different environmental and transfer conditions, and also it can effectively prevent flapping of the paper frequently caused during transfer of the developed image from a photosensitive drum having a small drum diameter, i.e., large curvature surface. Preferably, the transfer roller comprises an electrically conducting body of the elastic material with closed cells having, on the peripheral surface thereof, an insulating coating.

In the image transfer roller, a predetermined level of constant electric current is preferably applied thereto. The operation of the transfer roller at the constant electric current is effective to constantly supply an electric charge to the paper, thereby to prevent, or at least to inhibit, a reduction in the transfer efficiency caused by environmental conditions. Further, a predetermined level of constant voltage is preferably applied to the transfer roller. The operation of the transfer roller at the constant voltage is effective to attain a good transfer efficiency and a stable transfer of the toner images.

In order to receive the developed toner images from the photosensitive drum 1 any conventional materials such as paper, for example, plain paper, coated paper or synthetic paper, plastic sheets or films and others may be used as the image-receiving element. Before use, the material may be stored in a cassette or box or alternatively it may be stored in the form of roll and cut to the predetermined size before or after image transfer.

After the image transfer has been completed, the paper 21 as the image-receiving element with the transferred image is guided to an image fixation station 12. Heating, solvent vapor fusing or other conventional technologies may be used in the image fixation station depending upon the specific toners and other factors. Preferably, a pair of fixing rollers may be used, and the images can be fixed to the paper 21 upon heating or fusing.

Figure 12:
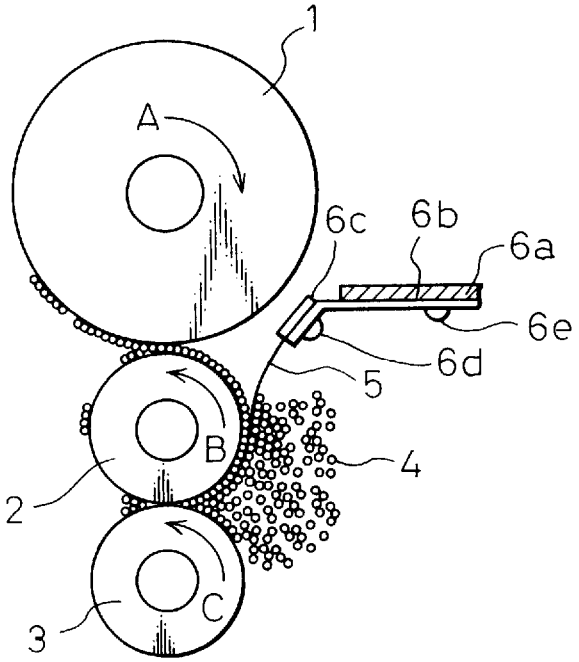
FIG. 12 is a cross-sectional view illustrating the constitution of the blade according to one preferred embodiment of the present invention.

FIG. 12 illustrates a selected part of the developing station of FIG. 8 including the toner thickness-controlling blade 5 of the present invention. The rotative directions of the photosensitive drum 1, developing roller 2 and toner-supplying and -receiving roller 3 are represented by the arrows "A", "B" and "C", respectively.

The blade 5 used herein is made of a plate of spring stainless steel which is a typical example of a suitable resilient metal material. In the practice of the present invention, this and other spring steel materials may be used as the resilient metal material. These spring steel materials are commercially available, for example, under the following names and standards.

| Name of material | JIS standard | Symbol |
|---|---|---|
| spring stainless steel (austenite) | JIS G 4313 | SUS 304-CSP |
| spring phosphor bronze | JIS H 3130 | C5210P or C5210R |
| spring stainless steel (deposition hardening) | JIS G 4313 | SUS 631-CSP |
| spring steel (cold rolling) | JIS G 4802 | SK5-CSP |
| spring beryllium-copper | JIS H 3130 | C1720P or C1720R |

A base end of the blade 5 is integrally fixed to a holder **6*b* through a press plate 6*c* and a screw 6*d*, and the holder 6*b* is integrally fixed to an end portion of the frame 6*a* of the developing station. The frame 6*a* and holder 6*b*** are preferably made of an electrically insulating resin material such as ABS resin.

Figure 13:
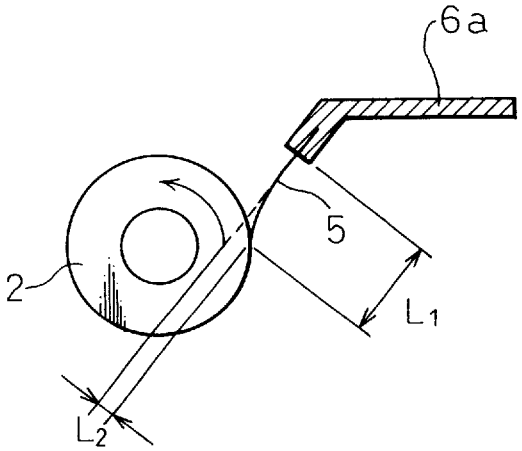
FIG. 13 is a cross-sectional view illustrating the constitution of the blade according to another preferred embodiment of the present invention.

FIG. 13 illustrates the toner thickness-controlling blade 5 according to another preferred embodiment of the present invention. As is illustrated, a base end of the blade 5 is directly inserted in and fixed to a frame **6*a* of the developing station. The frame 6*a* is made of an insulating material, ABS resin. The fixation of the blade 5 to the frame 6*a* can be preferably attained by using insertion molding, however, any other methods such as forced insertion of the blade into a slit of the frame may be used. Since fewer parts are used in the fixation of the blade, the blade of FIG. 13 can be produced in a simpler method at lower costs, in comparison to the production of the blade of FIG. 12**.

The function of the toner thickness-controlling blade according to the present invention will be further described referring again to FIG. 12. As is illustrated, a developing roller 2 rotating at the rotative direction "B" is disposed in adjacent to or in contact with a surface of the photosensitive drum 1 rotating at the rotative direction "A", and a toner-supplying and receiving roller 3 rotating at the rotative direction "C" is disposed in contact with a surface of the developing roller 2. The blade 5 is disposed in a position between the roller 3 and the drum 1 so that its tip can contact a surface of the roller 2 against the rotation of the roller 2 (rotative direction "B").

Using the blade of FIG. 12, as illustrated in FIG. 8, a voltage of −420 volts is applied to the roller 3, and a voltage of −320 volts is applied to the roller 2. Since these rollers are electrically charged, the toner 4 (see, FIG. 12) carried from the roller 3 to the roller 2 as a function of the rotation of the roller 3 is electrified by charge introduction and triboelectrification and is thus deposited onto a surface of the roller 2. Then, the toner 4 deposited on the roller 2 is further triboelectrified by friction under pressure and change introduction between the rollers 3 and 2, and during rotation of the roller 2 under pressurized contact of the roller 2 with the blade 5. The toner 4 which was passed under the blade 5 can thus provide a thin toner layer having an uniform layer thickness.

With rotation of the developing roller 2, the resulting toner layer 4 is conveyed to a developing area in which the opposed roller 2 and drum 1 are in adjacent to or contacting each other. In the developing area, the toner layer 4 is imagewise transferred from the roller 2 to the drum 1. Namely, the toner 4 on the developing roller 2 is selectively transferred and adhered to a latent image portion on the photosensitive drum 1, thereby making the latent image visible. The reminder of the toner 4, i.e., the not-transferred toner, is again contacted with the roller 3 with rotation of the roller 2. Upon contact with the roller 3, the toner 4 remaining on the roller 2 is partly scraped with the roller 3, and a substantial portion of the toner 4 is conveyed against the blade 5, after being scattered. The above-mentioned steps are repeated around the developing roller 2 in each imaging process.

Figure 14:
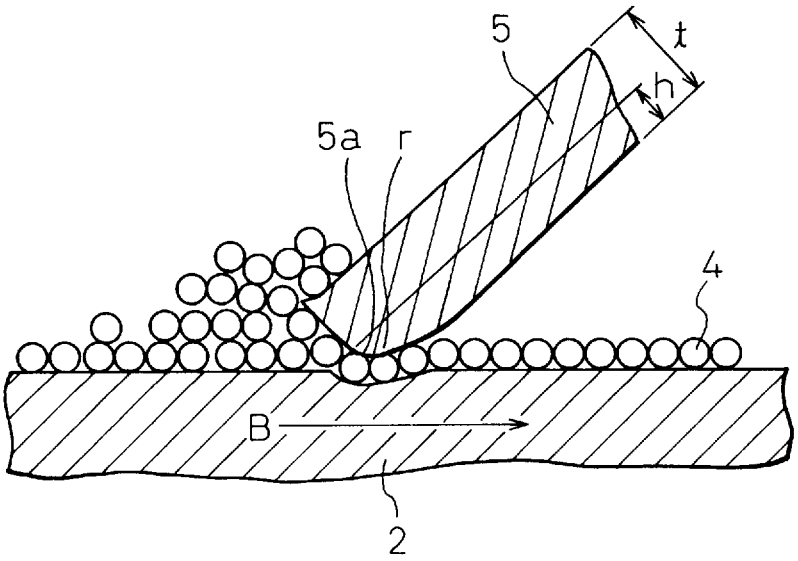
FIG. 14 is a cross-sectional view illustrating the contacting condition of the blade according to the present invention with a toner-carrying surface of the developing roller.
Figure 15:
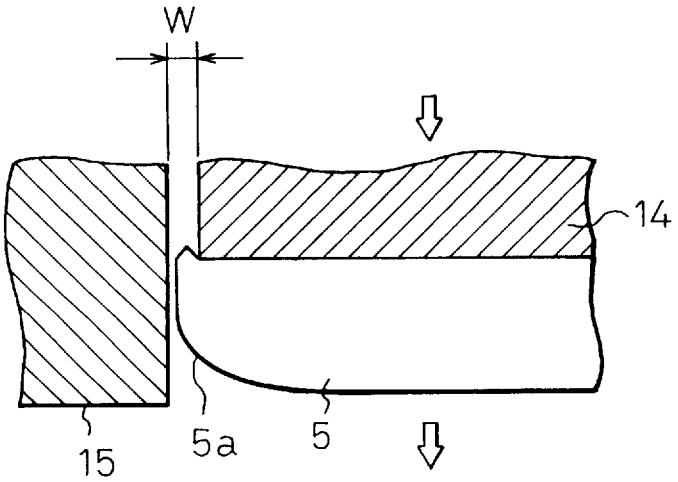
FIG. 15 is a cross-sectional view illustrating the production of the blade according to the present invention.

The above-mentioned toner thickness-controlling blade can be preferably produced in the manner illustrated in FIG. 15. The resilient metal plate such as spring stainless steel plate for forming a blade 5 is set in a punching mold comprising a punch 14 and a die 15, and then the die 14 is moved in the direction shown by an arrow. The distance or clearance "w" between the punch 14 and the die 15 is preferably controlled so that upon punching, the resulting blade 5 can contain an arc-like curved tail 5*a* having a smooth surface. The curved tail 5*a* is produced as a shear drop (generally, drawback) during punching, however, surprisingly, if it is used as the toner thickness-controlling blade of the present invention, the blade 5 can exhibit remarkable synergistic effects of controlling a toner thickness over the developing roller and triboelectrifying the toner without further fabrication or processing of said curved tail 5*a*. It is considered that the smoothness of the curved tail is also contributing this effect. The size of the toner thickness-controlling blade can be widely varied depending upon various factors such as desired effects and the like, however, preferably, it has a length "$L_1$", determined from an end of the frame 6*a* or holder 6*b*, of 12 to 22 mm (see, FIGS. 12 and 13) and a thickness "t" of 0.10 to 0.12 mm (see, FIG. 14) as well as a height "h" of the curved part (curvature) "r" of said tail part of 13 to 43 microns.

The blade of the present invention, if it is produced by punching a resilient metal plate having a thickness "t" of 0.1 to 0.12 mm, can fully maintain and exhibit a resiliency and flexibility of the metal plate used as a raw material of the blade, thereby ensuring a good contact of the blade top with a surface of the developing roller under a suitable pressure. Further, since it can be produced by punching a thin resilient metal plate in a press mold, the blade can be produced in a simple manner and at remarkably reduced costs. Furthermore, due to its specific curved tail structure, the blade can diminish a stress against the toner and thus deterioration of the toner, thereby ensuring extended life of the toner and high quality of the resulting toner images.

Further, the blade 5 is characterized by having a height "h" of the curvature "r" in the range of 13 to 43 microns at the curved tail 5*a* thereof (see, FIG. 14). When a tip of the blade 5 is contacted with a surface of the developing roller 2, a small gap is produced between the blade tip and the roller surface due to said height of the curvature. The resulting gap is effective to control an amount of the toner passed through said gap and thus form a uniform toner layer having a predetermined thickness.

In addition to these advantages, since a length "$L_1$" (see, FIG. 13) of the blade 5 is in the range of 12 to 22 mm, the blade 5 can fully exhibit a resiliency and flexibility of the resilient metal plate used as the starting material. Because of excellent resiliency and flexibility thereof, the blade 5 can contact the surface of the developing roller 2 under a moderately controlled pressure, thus avoiding an unevenness of the toner thickness in an axial direction of the roller 2.

Moreover, a tail part of the blade is preferably pressed at a pressure of 15 to 45 gf/cm against a surface of the developing roller. The controlled pressure of the blade is effective to diminish the stress against the toner and, at the same time, obtain a suitably controlled contacting pressure of the blade with the roller.

The above-mentioned advantages obtained by using the blade of the present invention will be more appreciated after referring to FIG. 14 in which a surface of the developing roller 2 is illustrated to be substantially flat because of a large magnification thereof. If the blade 5 is contacted with the developing roller 2 as illustrated, i.e., in such manner that a round edge of the curved tail 5*a* of the blade 5 can contact a surface of the roller 2, and a predetermined pressure or pushing force is applied to the blade 5, a uniform toner layer 4 having a predetermined thickness can be formed on a surface of the roller 2 and, at the same time, a predetermined level of charge can be given to the toner 4.

As a result, a reduction of the electrification characteristics of the toner 4 and "fogging" in the background of the images can be prevented, thus high image qualities can be obtained. Further, due to good resiliency thereof, the blade 5 can contact the roller 2 with a suitable contacting pressure, and also, due to its arc-like curved tail and the low friction coefficient of the metal, the stress load against the toner 4 can be notably reduced.

EXAMPLES

To ascertain the above-mentioned advantages of the present invention, the inventors have made experiments which will be described hereinafter.

The blades of the present invention having different thickness "t" and length "$L_1$" and the comparative blades which are not included in the scope of the present invention due to higher or lower thickness and/or length thereof were produced from the spring stainless steel (JG-SUS304-CSP) in accordance with the manner described above with reference to FIG. 15. The blade was installed in a printer produced by Fujitsu Limited, and the printing tests were made with regard to unevenness of the image density due to the uneven layer thickness of the toner and "fogging" of the background of the images due to insufficient electrification of the toner. The results are summarized in the following Table 1. Note that in the table, "yes" means that good results could be obtained with regard to the tests for the image density and "fogging" and "no" means that the results are bad and not acceptable. Note also that the density (optical density) and "fogging" were measured on a Macbeth densitometer, RD918.

TABLE 1

| | | length ($L_1$) of the blade (mm) | | | | | | | | |
|---|---|---|---|---|---|---|---|---|---|---|
| | | 10.0 | 12.0 | 14.0 | 16.0 | 18.0 | 20.0 | 21.0 | 22.0 | 24.0 |
| thickness (t) of the blade (mm) | 0.08 | NO | NO | NO | NO | NO | NO | NO | NO | NO |
| | 0.10 | NO | YES | YES | YES | NO | NO | NO | NO | NO |
| | 0.12 | NO | NO | YES | YES | YES | YES | YES | YES | NO |
| | 0.15 | NO | NO | NO | NO | NO | NO | NO | NO | NO |

The above results indicate that when the blade has a length of less than 12 mm or more than 22 mm or a thickness of less than 0.10 mm or more than 0.12 mm, a resiliency of the spring steel constituting the blade can not be fully exhibited and accordingly only insufficient pressure can be applied from the blade to the developing roller during contact of the blade with the roller. Accordingly, if the developing roller used has a varied outer diameter due to bad production accuracy thereof, a thickness of the toner layer can be varied in an axial direction of the roller, and the resulting thick toner layer can cause "fogging" and uneven density of the images.

Further, the blade having a thickness of less than 0.10 mm has only an insufficient rigidity and accordingly only a low pressure can be applied from the blade to the developing roller. To avoid this problem, it is suggested to adjust the fitting condition of the blade to the frame or holder to obtain a higher pressure, however, this causes a problem that the blade can buckle, thereby causing lifting up of the curved tail and thus contacting of a body of the blade with the roller. Insufficient contacting pressure of the blade cannot be improved even if charge introduction is additionally made, and thus, due to insufficient friction and electrification of the toner, "fogging" can be produced in the resulting toner images. The same problems can be also caused when the body of the blade is contacted with the roller as above mentioned because, due to insufficient contacting pressure, the friction is insufficient and therefore the level of the electrification of the toner can be remarkably increased. It should be also noted that if a surface of the developing roller has depressions or other defects, the defects will cause a notable unevenness of the thickness of the toner layer.

The toner thickness-controlling blade of the present invention can also exhibit remarkable effects when used in an imaging station for an extended period of time. Namely, the contacting pressure of the blade is very stable, because it can be effectively controlled by a deflection level "$L_2$" (see, FIG. 13) of the blade 5 made of a resilient metal plate. Further, any creep can be prevented in the blade by suitably selecting a deflection level of the blade. For example, when the blade is made of a spring stainless steel (JG-SUS304-C'SP-3/4H), any creep can be prevented, if the deflection level "$L_2$" is adjusted to within a certain range in which a fatigue strength of the stainless steel used is 33 kgf/mm$^2$ and $10^8$ cycles or less under the JIS standard. Further, the blade can be stably and repeatedly used for a long time, because the toner does not fixedly adhere to a tip portion of the blade.

Next, the height "h" of the curvature "r" in the curved tail 5*a* of the blade 5 (see, FIG. 14) which is contacted with the developing roller 2 will be explained.

In the previous experiments the height "h" of the curvature "r" is 23 microns, and the results thereof are summarized in Table 1. When the blade has a desirable thickness "t" and length "$L_1$" within the scope of the present invention, satisfactory results could be obtained, however, when the height "h" was changed from 23 microns to less than 13 microns, comparable results could not be obtained, because most of the toner 4 could not pass through a contacting site of the blade 5 and roller 2. Contrary to this, when the height "h" is more than 43 microns, a thickness of the resulting toner layer could be excessively increased as a result of large amounts of the toner passed through said contacting site, and thus "fogging" was caused due to insufficient friction between the blade and toner thus inhibiting electrification of the toner. Accordingly, by controlling the height "h" of the curvature "r" to the range of from 13 microns to 43 microns, it becomes possible for the toner to selectively pass through a gap between the blade and developing roller to make an uniform toner layer having a predetermined thickness on the roller surface, and stably retain the formation of such desirable toner layer, even if an angle of the contacting blade to the roller surface was widely varied.

The production of the blade having the height "h" of the curvature "r" in the tail thereof will be further explained.

As has already explained referring to FIG. 15, when a thin resilient metal plate having a thickness of, for example, 0.1 mm was punched in a press mold according to the present invention, an arc-like smooth curvature "r", i.e., shear drop, is produced in a tail part of the resulting blade due to the gap or clearance "w" between the punch and die of the mold. Contrary to this, in the prior art production methods, such an arc-like curvature could not be found in the resulting blades. This is because, in the prior art methods, the clearance "w" was generally adjusted to about one tenth or less of the thickness of the blade in order to improve a workability (cutting property) of the plate in the mold and also prevent flash, burr and other defects in the resulting blade. For example, if this prior art method is applied to the above instance of the present invention, the clearance "w" has to be 0.01 mm or less. Namely, in the conventional press molds, it is difficult to produce the blades having the height "h" of 13 to 43 microns.

Taking the above facts in mind, the inventors have made the experiments in order to ascertain a relationship between the clearance "w" of the mold and the height "h" of the curvature "r" at the curved tail of the blade with different hardness Hv of the resilient metal plates. The resilient metal plates used are three spring stainless steel plates (JG-SUS304-CSP-1/2H, Hv=280; JG-SUS304-CSP-3/4H, Hv=340; and JG-SUS304-CSP-H, Hv=400), each having a thickness of 0.1 mm. The results are plotted in FIG. 16.

Figure 16:
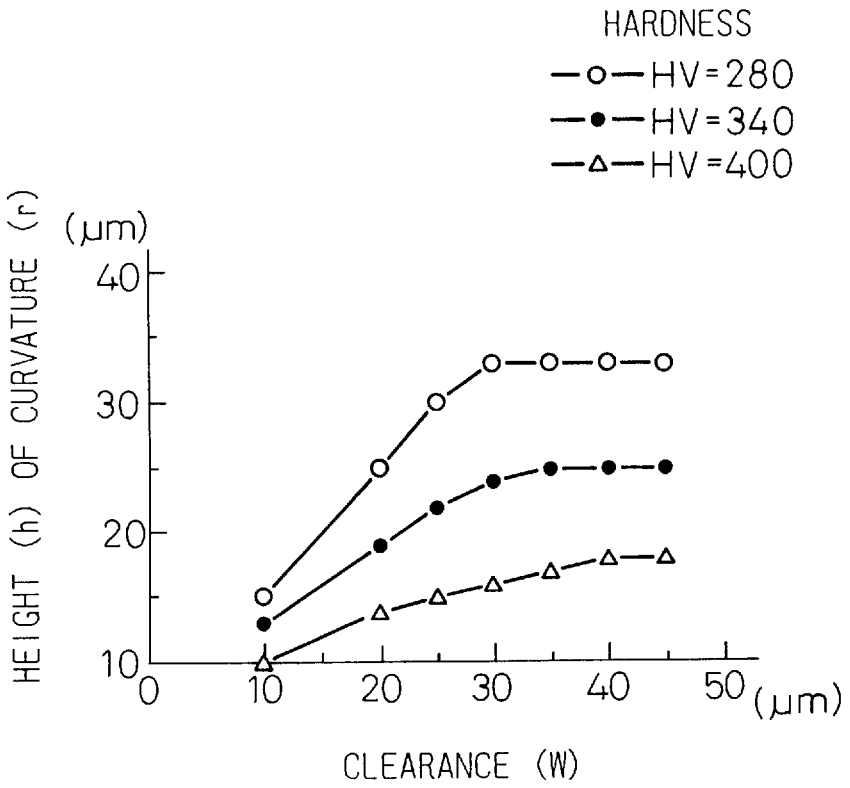
FIG. 16 is a graph showing a relationship between the clearance (w) between the punch and die in the mold and the height (h) of the curvature (r) in the resulting curved part of the blade.

As is apparent from FIG. 16, when the hardness of the spring plate is changed and the clearance "w" is increased from 0.01 mm to 0.045 mm, the curvature "r" at the curved tail, i.e., shear drop, is gradually increased. When the clearance "w" is 0.02 mm or more, the height "h" of the curvature "r" could be controlled to within the scope of 13 to 33 microns for all the spring plates.

Figure 17A:
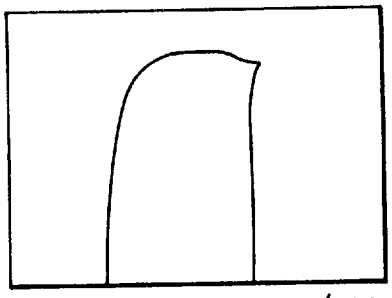
FIG. 17(A), 17(B) and 17(C) are illustrations of the cross-section of the tip portion of each of the three different blades, sketched referring to the electron micrograph for each tip portion.
Figure 17B:
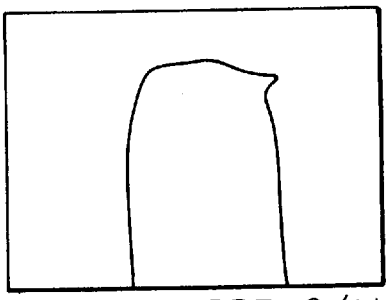
Figure 17C:
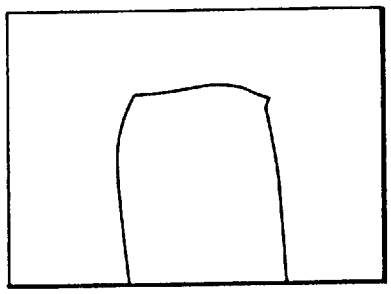

FIG. 17 is an illustration of the cross-section of the tip portion of each of three blades produced in the above-mentioned experiments, sketched referring to the electron micrograph (×400) for each tip portion. The illustrated cross-sections indicate that the height "h" of the curvature "r" is preferably 13 to 43 microns, more preferably, about 30 to 43 microns.

Moreover, the height "h" of the curvature "r" can be increased by increasing the thickness of the spring plate used. For example, when two spring stainless steel plates (JG-SUS304-CSP-3/4H) having a thickness of 0.1 mm (first sample) and 0.2 mm (second sample) were punched in a press mold having a clearance "w" of 0.01 mm, the resulting blades indicated the height "h" of 11 microns (first sample) and 20 microns (second sample). Namely, the height "h" can be suitably controlled by changing a thickness of the spring plate used. Apparently, for the blade of the present invention, the height "h" of 13 to 43 microns can be obtained if the plate has a thickness "t" of 0.1 to 0.12 mm.

Figure 18:
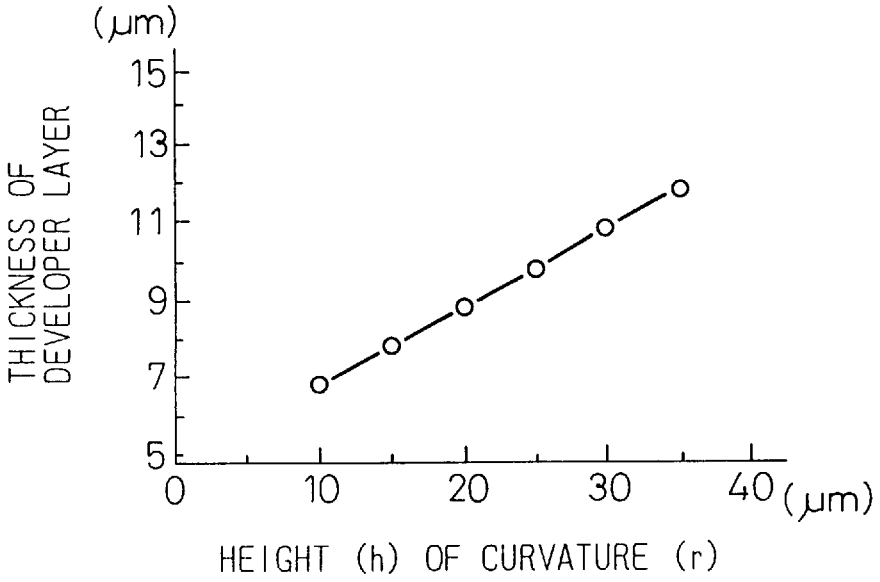
FIG. 18 is a graph showing a relationship between the height (h) of the curvature (r) in the resulting curved part of the blade and the thickness of the developer layer on the roller surface.

FIG. 18 indicates the results of the experiments in which the thickness of the developer (toner) layer was varied with variation of the height "h" of the curvature "r" in the curved tail of the blade. As plotted in FIG. 18, the thickness of the toner layer increases with an increase of the height "h" of the curvature "r", namely, it is appreciated that there is a certain relationship between said toner thickness and said height "h" of the curvature "r".

Figure 19:
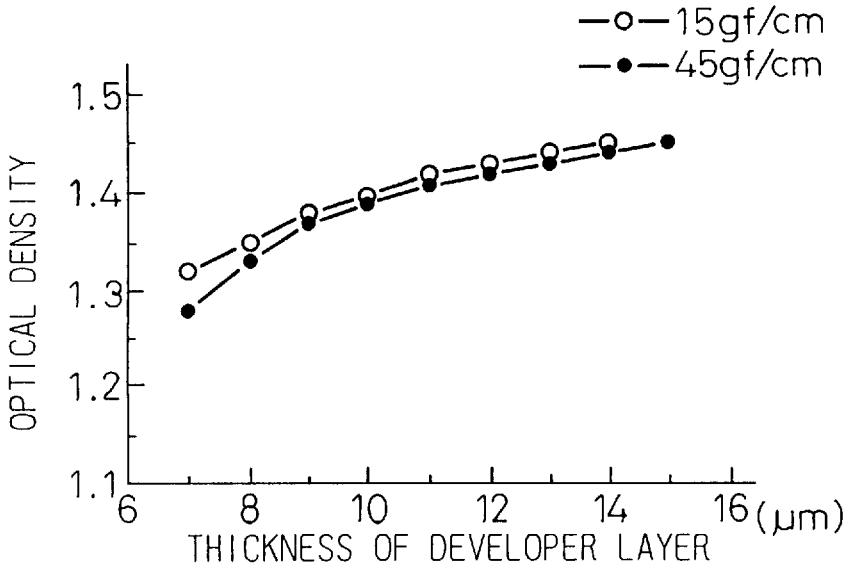
FIG. 19 is a graph showing a relationship between the thickness of the developer layer on the roller surface and the optical density of the image on the photosensitive drum.

FIG. 19 is a graph showing a relationship between a thickness of the developer (toner) layer and an optical density of the resulting images. This graph indicates that the optical density (O.D.) is increased with increase of the thickness of the toner layer.

Figure 20:
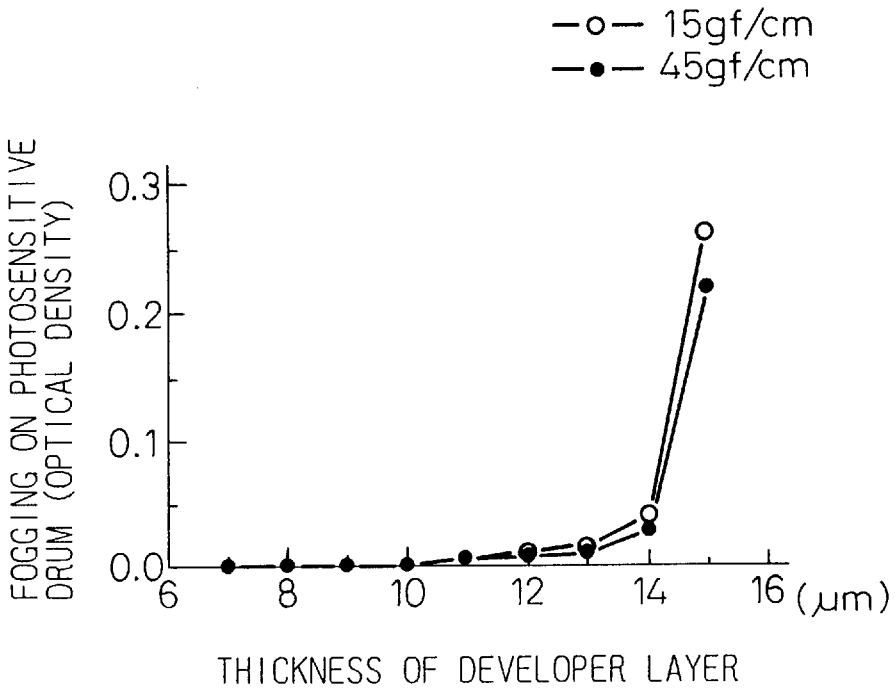
FIG. 20 is a graph showing a relationship between the thickness of the developer layer on the roller surface and the fogging (density) on the photosensitive drum.

FIG. 20 is a graph showing a relationship between a thickness of the developer (toner) layer and "fogging" (O.D.) of the image on the photosensitive drum. This graph indicates that the "fogging" of the image is increased with increase of the thickness of the toner layer.

As is understood from the above results, there is a correlation between the image density and "fogging", and therefore a thickness of the toner layer has to be controlled to within the range of about 8 to 14 microns. The toner layer having this predetermined thickness can be produced according to the present invention, if the height "h" of the curvature "r", as mentioned above, is controlled to within the range of 13 to 43 microns. On the other words, the above is the requirements for obtaining stable image density and high image quality without fogging.

Finally, the application of the pressure (contacting pressure) of 15 to 45 gf/cm to a developing roller will be explained.

As above mentioned, in the practice of the present invention, a tail part of the blade is preferably pressed at a contacting pressure of 15 to 45 gf/cm to the surface of the developing roller. This is because the contacting pressure of less than 15 gf/cm is insufficient to fully exhibit a resiliency or flexibility of the resilient metal plate constituting the blade, since said contacting pressure ensures only weak contacting force of the blade to the roller. These disadvantages, particularly when the developing roller used has a varied outer diameter due to its bad fabrication accuracy, can result in unevenness of the thickness of the toner layer in an axial direction of the developing roller, and the resulting toner layer having an increased thickness can cause defects such as "fogging" and unevenness of the image density. In addition to these drawbacks, a deflection level "$L_2$" (see, FIG. 13) of the blade is reduced, and thus the contact of the blade with the developing roller was unstabilized due to the reduced contacting margin between the blade and roller.

On the contrary, a contacting pressure of more than 45 gf/cm causes buckling of the blade and thus a lifting up of a curved tail of the blade. Accordingly, the body (not the tail) of the blade can contact a surface of the developing roller. This problem can not be solved even if the position of the curved tail is controlled. Namely, in such case, since the pressure applied to the developing roller is excessively increased, a large stress can be applied to the toner, and upon repeated use thereof, the toner with the applied stress can be deteriorated, i.e., an electrification level of the toner can be reduced, thereby thickening the line of the images and further fogging the images.

Apparently, when the blade has only a weak contacting pressure, insufficient friction of the toner cannot be improved, even if an electric charge is additionally introduced to the toner. Since the electrification level of the toner is increased due to less friction of the toner, "fogging" can be produced in the resulting images. Further, an electrification level of the toner can be remarkably increased, if a body of the blade is contacted with the developing roller, because a contacting pressure of the blade per unit surface thereof is not high due to said contact of the body of the blade with the roller, and thus lack of the friction power of the toner is not avoidable. Further, depression and other defects on a surface of the developing roller will cause very notable unevenness in the thickness of the resulting toner layer.

Accordingly, by selecting, as a contacting pressure applied from the blade to the developing roller, a certain value within the range of 15 to 45 gf/cm, high quality images having a stable image density and no fogging can be obtained. Note that these good image qualities were described above with reference to FIGS. 19 and 20.

Using the nonmagnetic one-component type developing device described in the above example, a toner layer having a stable and uniform thickness can be always obtained. Of course, this effect of the present invention can be retained, even if an angle of the blade to the developing roller is changed or an outer diameter of the developing roller is varied in an axial direction of the roller. Further, a constant contacting pressure of the blade can be retained both for an extended time of lack of use and for an extended time of use.

We claim:

1. A blade for controlling a layer thickness of a developer and/or triboelectrically charging the developer on a surface of a developing roller in an electrographic imaging device, said blade comprising:

a longitudinally extended straight member having a thickness and made by punching a thin resilient plate of metal in a press mold, and a tip portion thereof has a curved tail part having a smooth surface and a gradually reduced thickness formed as a shear drop upon said punching, said tail part being able to be pressed against and elastically contacted with a developer-carrying surface of the developing roller.

2. The blade as in claim 1, in which said resilient plate of metal is a spring steel plate.

3. The blade as in claim 1 or 2, in which said blade is mounted on a blade holder, and has a length of 12 to 22 mm and said thickness of 0.10 to 0.12 mm.

4. The blade as in claim 3, in which a height of the curvature of said tail part is 13 to 43 microns.

5. The blade as in claim 1 or 2, in which said tail part of the blade is pressed at a pressure of 15 to 45 gf/cm against the developer-carrying surface of said developing roller.

6. The blade as in claim 1 or 2, in which said blade is integrally bonded with a frame of developing station in the imaging device.

7. A method for production of a blade for controlling a layer thickness of a developer and/or triboelectrically charging the developer on a surface of a developing roller in an electrographic imaging device, which method comprises the steps of:

providing a press mold comprising at least one pair of punch and die, adjusting a gap between the punch and die to have a size sufficient to give a curved tail part of a tip portion of the blade during a subsequent punching step, and punching a thin resilient plate of metal in said press mold to therein form said blade as a longitudinally extended straight member having a thickness, a tip portion of which has a curved tail part having a smooth surface and a gradually reduced thickness formed as a shear drop, said tail part being able to be pressed against and elastically contacted with a developer-carrying surface of the developing roller in an electrographic imaging process.

8. The method as in claim 7, further comprising the step of forming said resilient plate of metal from a spring steel plate.

9. The method as in claim 7 or 8, further comprising the step of forming said blade to have a length of 12 to 22 mm and to have said thickness of 0.10 to 0.12 mm.

10. The method as in claim 9, further comprising the step of forming a height of the curvature of said tail part to be 13 to 43 microns.

11. An electrographic imaging device comprising: a developing station which includes a developing roller and a blade for controlling a layer thickness of a developer and/or triboelectrically charging the developer on a surface of the developing roller, in which said blade is a longitudinally extended straight member having a thickness and made by punching a thin resilient plate of metal in a press mold, and a tip portion thereof has a curved tail part having a smooth surface and a gradually reduced thickness formed as a shear drop upon said punching, said tail part being able to be pressed against and elastically contacted with a developer-carrying surface of the developing roller.

12. The imaging device as in claim 11, in which said developer is a nonmagnetic one-component type developer.

13. The imaging device as in claim 11 or 12, in which said resilient plate of metal is a spring steel plate.

14. The imaging device as in claim 11 or 12, in which said blade is mounted on a blade holder, and has a length of 12 to 22 mm and said thickness of 0.10 to 0.12 mm.

15. The imaging device as in claim 14, in which a height of the curvature of said tail part is 13 to 43 microns.

16. The imaging device as in claim 11 or 12, in which said tail part of the blade is pressed at a pressure of 15 to 45 gf/cm against the developer-carrying surface of said developing roller.

17. The imaging as in claim 11 or 12, in which said blade is integrally bonded with a frame of said developing station.

* * * * *